US005868382A

United States Patent [19]

Groves

[11] Patent Number: 5,868,382

[45] Date of Patent: Feb. 9, 1999

[54] VINYL GATE STRUCTURE

[76] Inventor: Michael F. Groves, P.O. Box 7288, Bend, Oreg. 97708

[21] Appl. No.: 934,272

[22] Filed: Sep. 19, 1997

[51] Int. Cl.[6] ..... E06B 11/00

[52] U.S. Cl. ..... 256/73; 52/660; 49/55; 256/29

[58] Field of Search ..... 52/660; 49/501, 49/55–57, 50, 395, 381; 292/302, 218; 403/231, 269; 160/215, 216; 256/29, 73

[56] References Cited

U.S. PATENT DOCUMENTS

| | | | |
|---|---|---|---|
| 3,395,489 | 8/1968 | Banse . | |
| 4,628,635 | 12/1986 | Maillard . | |
| 4,793,098 | 12/1988 | Wilkerson . | |
| 4,796,384 | 1/1989 | Warwick . | |
| 4,813,182 | 3/1989 | Daniels et al. . | |
| 5,457,914 | 10/1995 | Johnson | 49/463 |
| 5,556,080 | 9/1996 | Vise | 256/24 |
| 5,702,090 | 12/1997 | Edgman | 256/19 |
| 5,716,041 | 2/1998 | Groves | 256/73 |
| 5,771,505 | 6/1998 | Reynolds | 4/559 |

*Primary Examiner*—Carl D. Friedman
*Assistant Examiner*—Beth A. Aubrey
*Attorney, Agent, or Firm*—Robert D. Varitz, P.C.

[57] ABSTRACT

A vinyl gate structure includes a frame which has spaced-apart upright members and top and bottom cross-piece members extending there between. Each upright member includes a cross-piece receiver for the cross-piece members. Vinyl cross-piece covers, or cross-piece members, are provided, and vinyl web members generally extend between the cross-piece covers to provide a web for the fence. A typical fence is held together with four fasteners, located in the corners thereof, which fasteners secure the upright members, the cross-piece members and the vinyl cross-piece covers, thereby forming a solitary unit.

18 Claims, 6 Drawing Sheets

VINYL GATE STRUCTURE

FIELD OF THE INVENTION

This invention relates to gates for uses with fences, and specifically to a gate structure which is a combination of metal and vinyl, and which may be shipped in a compact form and assembled at its final destination.

BACKGROUND OF THE INVENTION

Because good fences make good neighbors, the variety and design of fences and gates has undergone significant change in the recent past. Although fence material may generally be compacted for shipment, gates are typically shipped in an assembled, or at least partially assembled, condition, which requires the use of a considerable amount of space in the transport vehicle. Because shipping costs are constantly increasing, it is important that all products moving in commerce be shipped in their most compact form to reduce shipping costs.

A number of known gate structures are suitable for shipment in a collapsed form. Maillard, U.S. Pat. No. 4,628,635, discloses one such gate structure which is assembled from multiple parts, and therefore may be disassembled for storage and transport.

Wilkerson, U.S. Pat. No. 4,793,098 discloses an adjustable gate, which adjustment is made by fracturing portions of the gate frame at predetermined intervals. This frame is also suitable for storage and shipping in disassembled form, although the frame is disclosed as a one piece welded structure, which does not provide for easy disassembly.

Warwick, U.S. Pat. No. 4,796,384 discloses a gate which is assembled from component parts, and which may therefor be stored and shipped in a disassembled form.

The aforementioned disclosures generally include some form of a metal framework having a metal or wood web placed thereover to form the completed gate. Again, because metal and wood are relatively heavy materials, there has been a tendency to construct fences and gates out of lighter materials, such as plastics, and specifically vinyl. Fences so constructed have the advantage of being substantially rust-free, corrosion-free and in most instances, are more attractive that conventional fences and gates. This leads to longer life, and additionally, provides a material that is much lighter, and is therefor much less expensive to transport. Known vinyl gates, however, continue to be preassembled by their manufacturers and require additional space in the shipping vehicle.

SUMMARY OF THE INVENTION

The vinyl gate structure of the invention includes a frame which has spaced-apart upright members and top and bottom cross-piece members extending there between. Each upright member includes a cross-piece receiver for the cross-piece members. Vinyl cross-piece covers, or cross-piece members, are provided, and vinyl web members generally extend between the cross-piece covers to provide a web for the fence. A typical fence is held together with four fasteners, located in the corners thereof, which fasteners secure the upright members, the cross-piece members and the vinyl cross-piece covers, thereby forming a solitary unit.

It is the object of the invention to provide a vinyl gate structure which is easily and cheaply manufactured.

Another object of the invention is to provide a vinyl gate structure which is constructed to be stored and transported in a compact, disassembled condition.

A further object of the invention is to provide a vinyl gate structure which is easily assembled at its final destination.

These and other objects and advantages of the invention will become more fully apparent as the description which follows is read in conjunction with the drawings.

DETAILED DESCRIPTION OF THE PREFERRED EMBODIMENT

Figure 1:
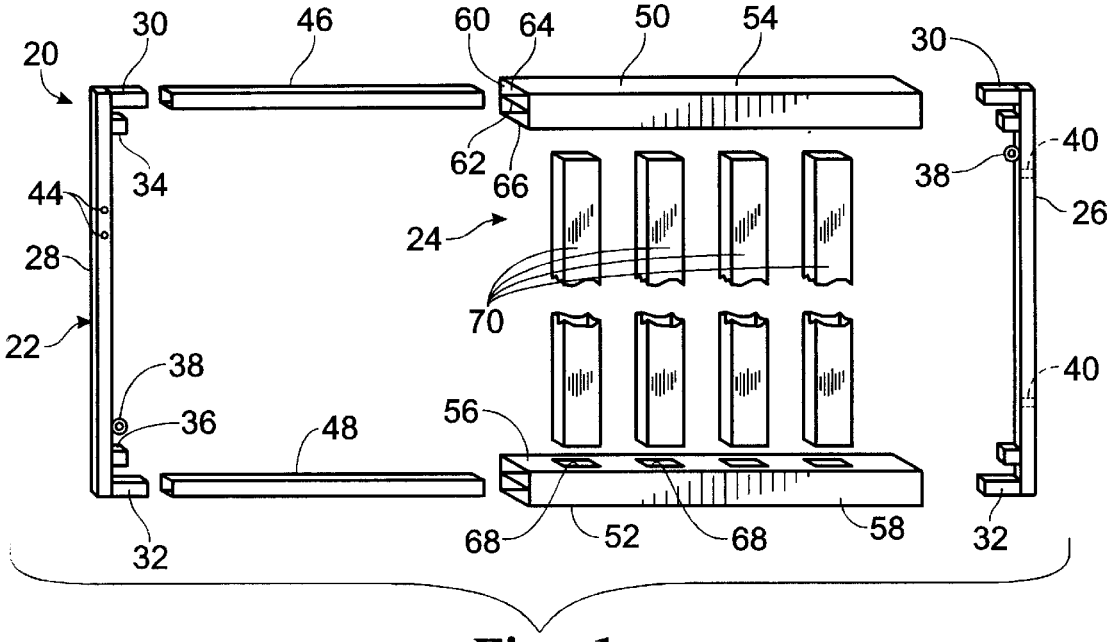
FIG. 1 is an exploded view of a first embodiment of the vinyl gate structure constructed according to the invention.
Figure 2:
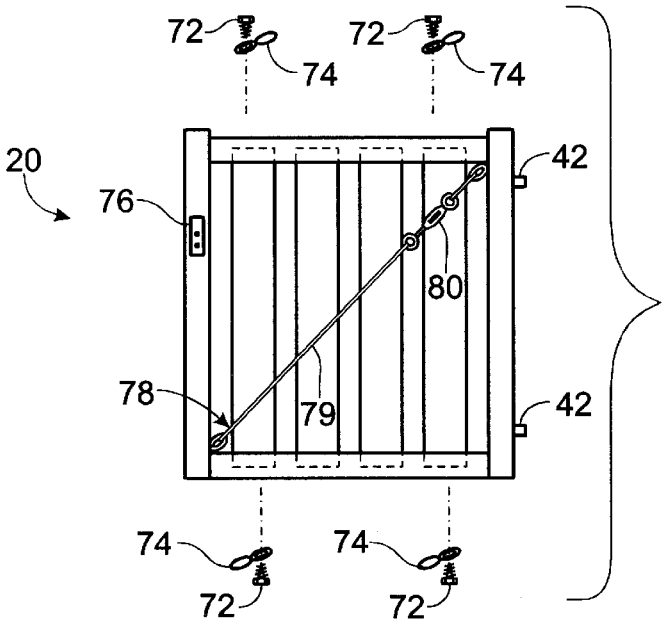
FIG. 2 is a front elevation of the gate structure of FIG. 1, in an assembled condition.

Turning initially to FIGS. 1 and 2, the vinyl gate structure of the invention will be described. The first embodiment of the vinyl gate structure of the invention is depicted generally at 20. Gate 20 includes a frame 22 and a web 24, which web extends over the frame, and provides varying degrees of obstruction in the gate.

Frame 22 includes a pair of spaced-apart upright members 26, 28. As depicted in FIGS. 1 and 2, upright member 26 is a hinge upright member and upright member 28 is a latch upright member. In this embodiment of the invention, each upright member includes a top cross-piece receiver 30 and a bottom cross-piece receiver 32. Additionally, a top stabilizer 34 and a bottom stabilizer 36 is provided. A truss receiver 38 is provided on each upright member. In the preferred embodiment, upright members 26, 28 are formed of 1.5"×1.5" tubular steel having a square cross-section. The length of these members may vary, generally from three feet to eight feet in length. Cross-piece receivers are formed, in the preferred embodiment, of tubular steel, welded to the upright members, and having a cross-section of 1.125" and a length of approximately four inches. Stabilizers 34, 36 are formed of tubular steel having a cross section of 1.25" and a length of 1". Upright member 26 has indicia 40 thereon for marking the location where gate hinge elements 42 are to be located. Upright element 28 has bores 44 formed therein for receiving a latch.

Continuing with the description of frame 22, a top cross-piece member 46 is received on top cross-piece receivers 30, and a bottom cross-piece member 48 is received on bottom cross-piece receivers 32. Cross-piece members 46, 48 are again formed of tubular steel and have a square cross-section of 1.25"×1.25", and are provided in lengths of 48" to 72". The lengths may of course be cut on site to provide a gate custom-fit to an opening in a fence. The portions of frame 12 described thus far are formed of metal, generally steel, and the upright members have the cross-piece receivers, stabilizers and truss receivers secured thereto by welding. The upright members and cross-piece members may be coated with a variety of rust and corrosion preventing materials, such as vinyl, paint, or in the case of an aluminum frame, suitable anodization.

A top cross-piece cover 50 fits over cross-piece member 46, while a bottom cross-piece cover 52 extends over bottom cross-piece member 48 and stabilizers 36. In the preferred embodiment of the inventions, covers 50, 52 are constructed of vinyl, which may be formed as by molding or, preferably, extrusion. Covers 50, 52 have what is referred to herein as horizontal surfaces 54, 56, and vertical surfaces 58, and 60. A divider 62 is formed in cross-piece covers 50, 52, which divides the interior of the cover into an upper chamber 64 and a lower chamber 66. As shown in the drawings, top cross-piece member 46 is inserted into upper chamber 64 of cover 50 while stabilizer 34 is received in lower chamber 66. Bottom of cross-piece member 48 is received in lower chamber 66 of cross-piece cover 52 while stabilizers 36 are received in upper chamber 64 thereof.

In this first embodiment of the gate structure, a number of discrete slots 68 are formed in horizontal surface 56 of cross-piece covers 50, 52. Vinyl web members 70 are inserted into slots 68 to form web 24 of the fence structure, thereby forming a barrier to passage through the gate.

In order to assemble gate structure 20 the gate must be properly sized. This is accomplished by cutting the length of cross-piece members 46, 48 to a desired length. This length will typically be approximately 6 inches less than the opening in the fence which is provided for the gate. Top and bottom cross-piece members 46, 48 are cut slightly shorter, approximately ⅛ inch, than the top and bottom cross-piece covers. This allows cross-piece members 46, 48 to fit over their respective receivers 30, 32 and to snugly hold the cross-piece covers thereon. One way to assemble the fence is to insert cross-piece members on their respective receivers, for instance on latch upright member 28, place cross-piece covers over the cross-piece members, insert vinyl web members in slots 68 and then place hinge upright member 26 in place with receivers 30, 32 placed in cross-piece members 46, 48, respectively. At this point, fasteners 72, which in the preferred embodiment are self-taping screws, are placed so as to penetrate, adjacent each corner, the cross-piece cover, the cross-piece member, and the respective receiver 30 or 32. A screw cover 74 may be installed along with fastener 72 in order to provide a finished look to the gate structure. Gate hinge elements 42 may then be installed, as may a latch 76. The gate now may be hung on the fence, and truss 78 installed. Truss 78 includes the usual truss wire 76, which extends from truss receiver 38 on latch upright member 28 to a turn buckle 80, which is connected to truss receiver 38 on hinge upright member 26. The truss is adjusted to square the gate in the gate opening of the fence.

Figure 3:
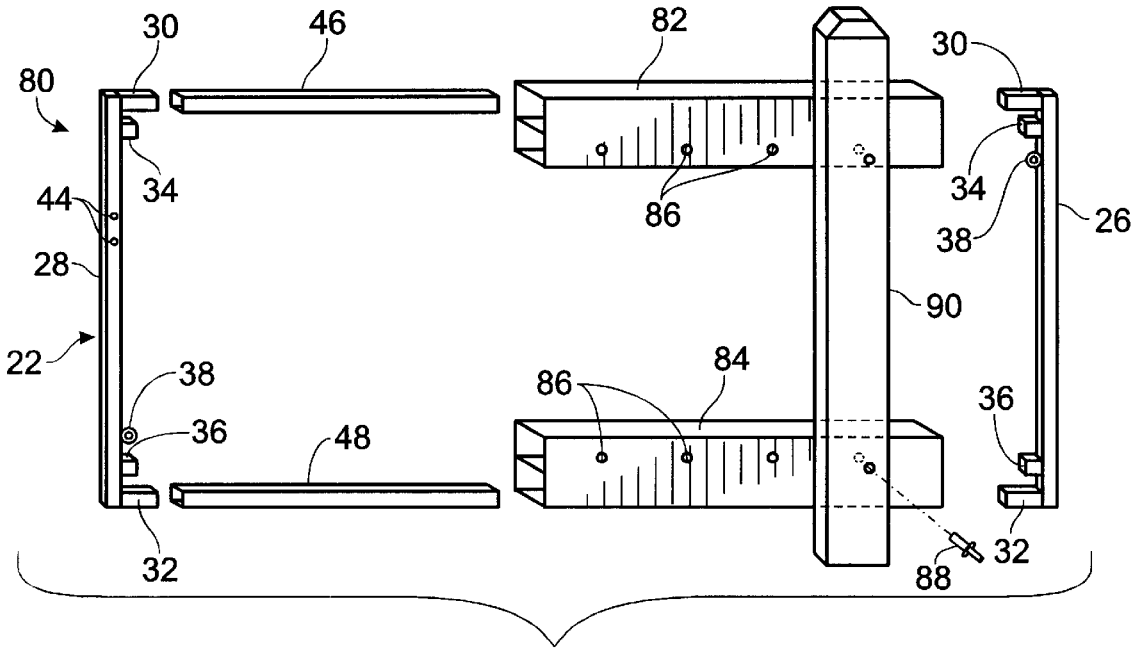
FIG. 3 is an exploded view of a second embodiment of the vinyl gate structure of the invention.
Figure 4:
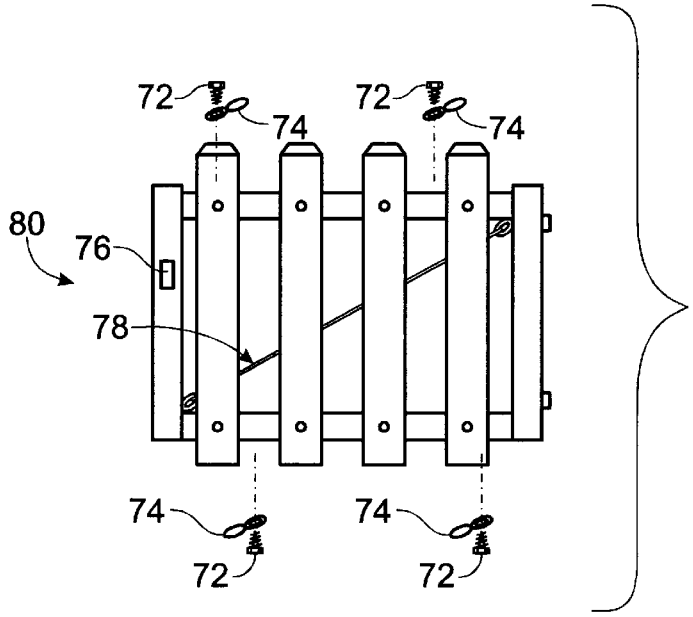
FIG. 4 is a front elevation of the assembled vinyl gate structure of FIG. 3.

Turning now to FIGS. 3 and 4, a gate structure for use with a picket fence is depicted at 80. Where the parts are the same as those in FIGS. 1 and 2, like reference numerals are used. In this embodiment, a top cross-piece cover 82 and a bottom cross-piece cover 84 are depicted. These structures are similar to cross-piece covers 50, 52 except that they do not have slots form therein. Instead, the cross-piece covers are formed with bores 86 therein which will receive a vinyl rivet 88, which secures a picket element 90 to the cross-piece covers.

The embodiments of the gate structure shown in FIGS. 1–4 provide a closure for an opening in a fence, and is effective to keep people and animals from passing through the gate opening. In many instances, however, a greater degree of privacy is required, and to that end, gates with solid webs therein are used. The next two embodiments of the gate structure of the invention provide such privacy.

Figure 5:
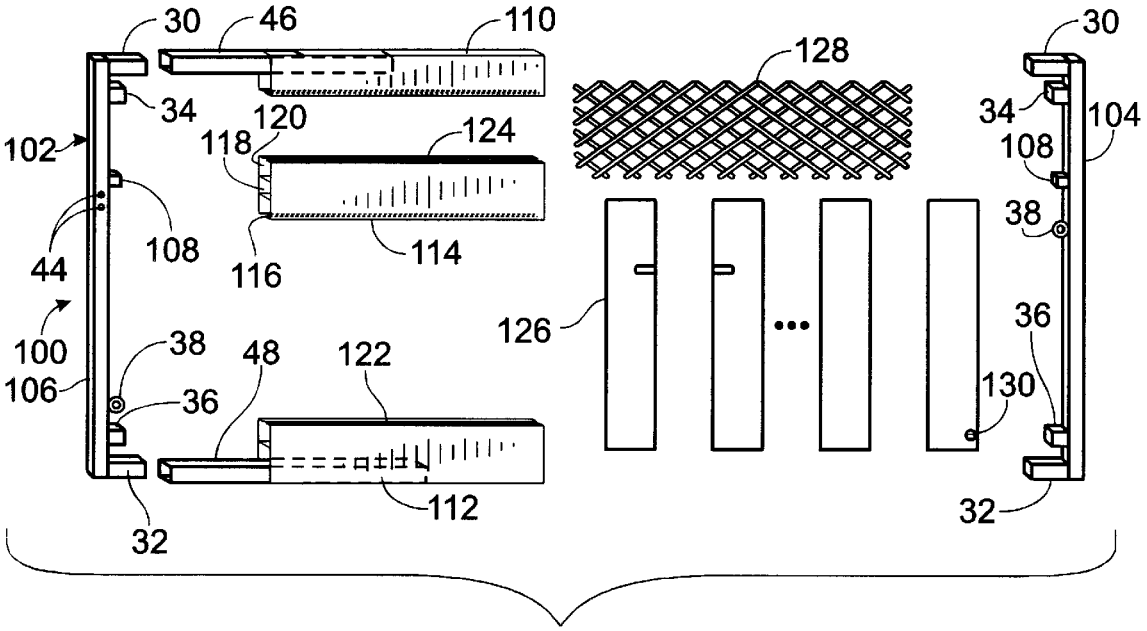
FIG. 5 is an exploded view of a lattice-top vinyl gate structure of the invention.
Figure 6:
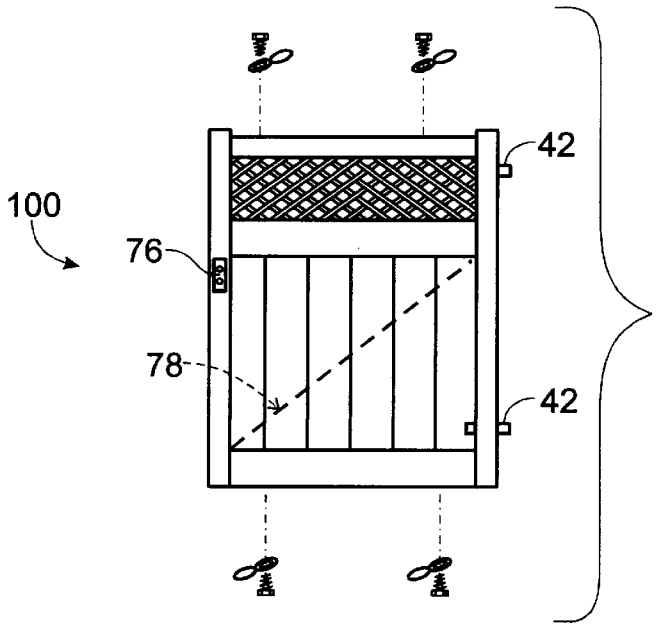
FIG. 6 is a front elevation of the assembled lattice-top vinyl gate structure of FIG. 5.

Referring now to FIGS. 5 and 6, a lattice-top privacy gate is depicted generally at 100. Again, where structures are like those in previously described embodiments, like reference numerals are used. A modified frame 102 is used in this embodiment. Frame 102 includes a hinge upright member 104 and a latch upright member 106. The upright members include top cross-piece receivers 30 and bottom cross-piece receivers 32, top stabilizers 34 and bottom stabilizers 36, and truss receivers 38. Additionally, intermediate cross-piece receivers 108 are located on each upright member between the top and bottom cross-piece receivers. A top cross-piece cover 110 is received on top cross-piece 46, a bottom cross-piece cover 112 is received on bottom cross-piece 48, and an intermediate cross-piece member 114 is received on intermediate cross-piece receivers 108. As is shown, bottom cross-piece cover 112 and intermediate cross-piece member 114 have three-compartments formed therein, a bottom compartment 116, and intermediate compartment 118 and a top compartment 120. In this embodiment, a continuous slot 122 extends along the top horizontal surface of bottom cross-piece cover 112. A like continuous slot (not shown) extends along the bottom horizontal surface of intermediate cross-piece member 114 and a continuous slot 124 extends along the top horizontal surface thereof. A continuous slot (not shown) extends along the bottom horizontal surface of top cross-piece cover 110. As is shown, slats 126 are placed in slot 122 in the top horizontal surface of cross-piece cover 112 and in the slot on the bottom surface of intermediate cross-piece 114. A lattice-like structure 128 is placed between intermediate cross-piece member 114 and top cross-piece cover 110. Because the web, formed by slats 126, is substantially solid across the face of gate 100, a notch, 130, may be required in the slat next to hinge upright member 104 to allow placement of gate hinge element 42 on the gate. Likewise, it may be necessary to remove a portion of lattice 128 for the top gate hinge element.

Figure 7:
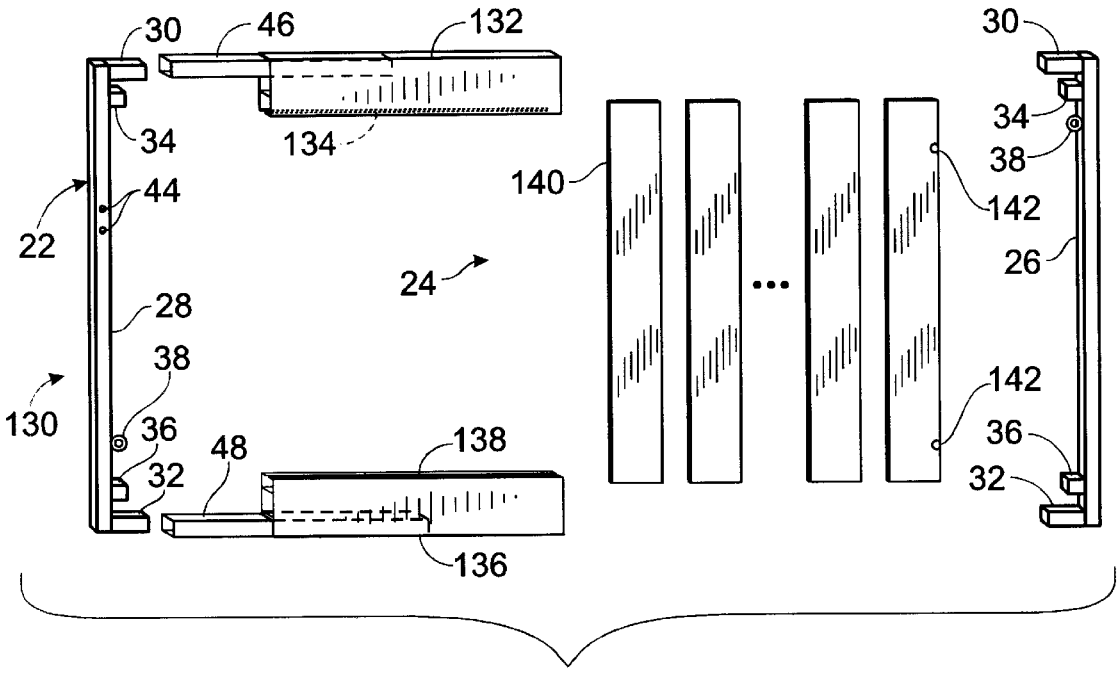
FIG. 7 is an exploded view of a solid privacy fence vinyl gate structure of the invention.
Figure 8:
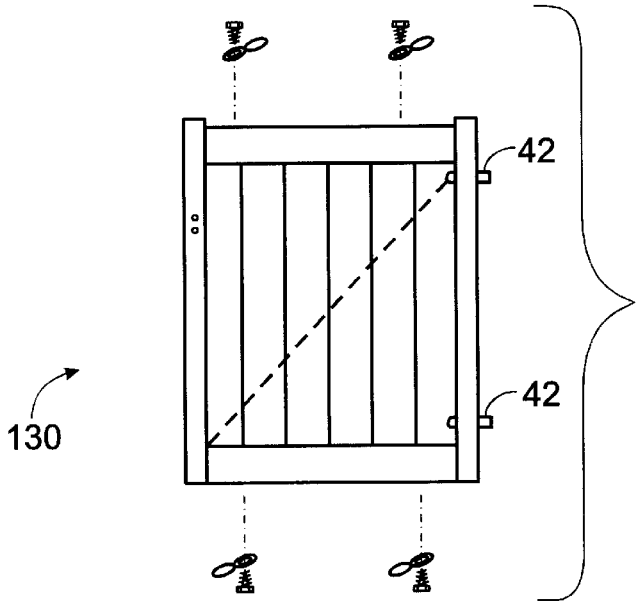
FIG. 8 is a front elevation of the assembled solid privacy fence vinyl gate of FIG. 7.

Turning now to FIGS. 7 and 8, a second form of privacy gate is depicted generally at 130. This embodiment uses frame 22, as previously described. A top cross-piece cover 132 is of the dual-compartment type, and includes a continuous slot 134 extending along the length of the cover in the bottom horizontal surface thereof. A bottom cross-piece cover 136 includes a continuous slot 138 extending along the length of the top horizontal surface thereof. Slats 140 are inserted in slots 134, 138 to form a solid web over the gate structure. As with the previously described embodiment, notches 142 may need to be formed in one of the slats to provide clearance for the gate hinge element 42.

Figure 9:
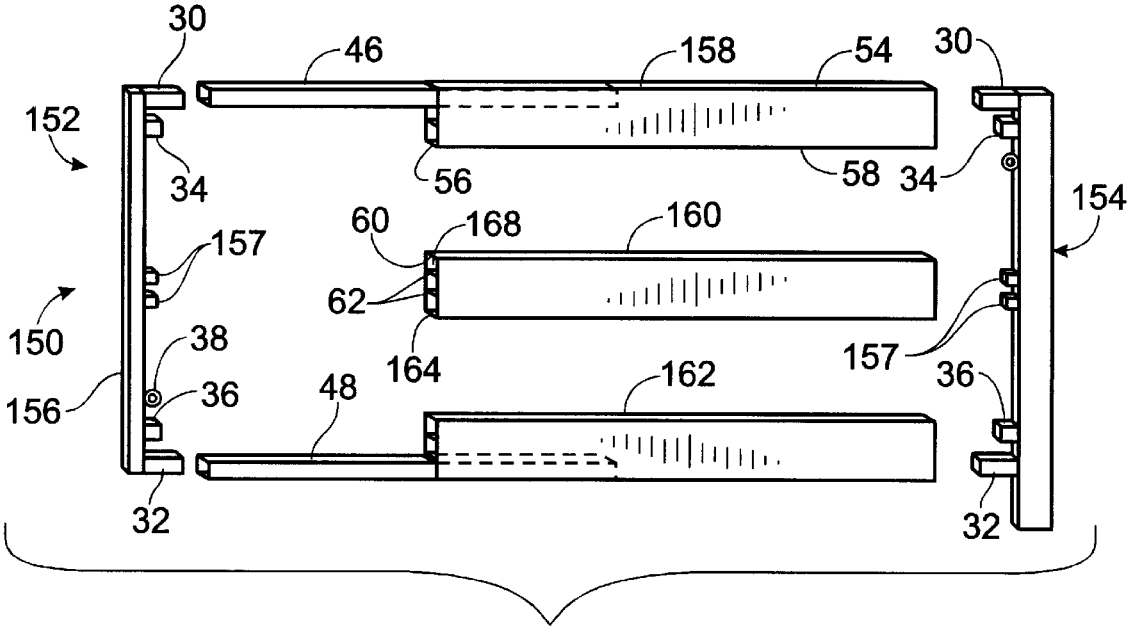
FIG. 9 is an exploded view of a ranch-style vinyl gate structure of the invention.
Figure 10:
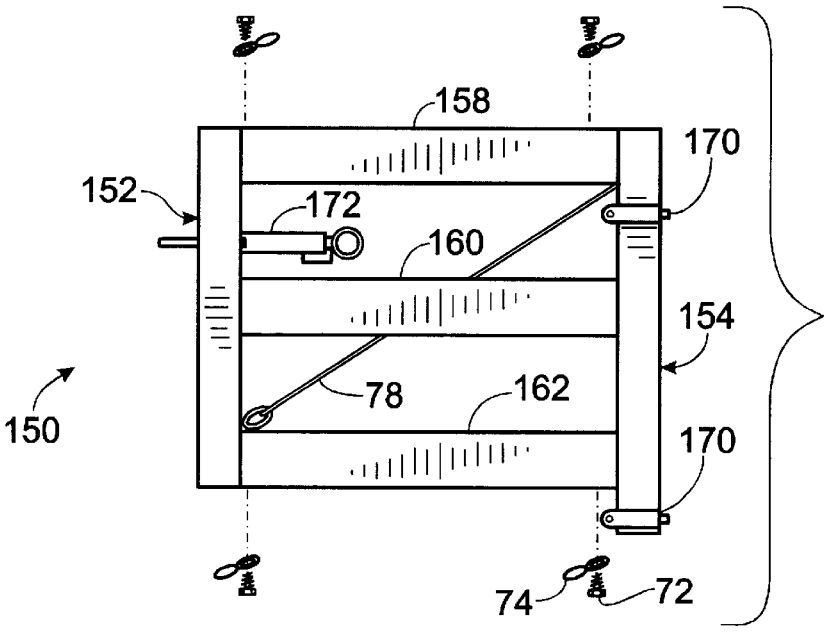
FIG. 10 is a front elevation of the assembled ranch-style vinyl gate of FIG. 9.

Referring now to FIGS. 9 and 10, a first embodiment of a ranch, or rail, type gate will be described. Because this type of gate is designed to span a greater distance than the previously described gates, heavier material is used for the frame. A ranch-type gate is shown generally at 150. Gate 150 includes a frame 152 which includes a hinge upright member 154 and a latch upright member 156. The upright members have cross-piece receivers 30, 32 formed thereon, a top stabilizer 34 and a bottom stabilizer 36, and a truss receiver 38. Intermediate cross-piece receivers 158 are formed on each upright member. Cross-piece members 46, 48 are provided. Upright members 154, 156, are formed from tubular steel, having a square cross-section of 1.25"×

1.25" inches. Cross-piece receivers are formed from tubular steel having a square cross-section of 1.125"×1.125" inches and a length of 4", while stabilizers 34, 36 have a 1.25" square cross-section and a length of 1". The cross-piece members are formed from tubular steel and have a 1.25" square cross-section. Typical lengths for the cross-piece members is six feet.

In this embodiment, a top cross-piece cover 158 and a bottom cross-piece cover 162 are provided. Additionally, an intermediate cross-piece member 160 is used. The top and bottom cross-piece covers and the intermediate cross-piece members are, in the preferred embodiment, formed of extruded vinyl and include top horizontal surfaces 54, bottom horizontal surfaces 56 front vertical surfaces 58 and rear vertical surfaces 60. The vertical surfaces of the cross-piece covers and the intermediate cross-piece member form the web of the gate in this form of the gate. Additionally, two dividers 62 are provided which split the structures into a lower compartment 164, and intermediate compartment 166 and an upper compartment 168. Once assembled, hinge elements 170 are secured to hinge upright member 154, and a latch 172 is secured to latch upright member 156. Latch 172 may be of the type described in Groves, U.S. Pat. No. D367,809, Issued Mar. 12, 1996.

Figure 11:
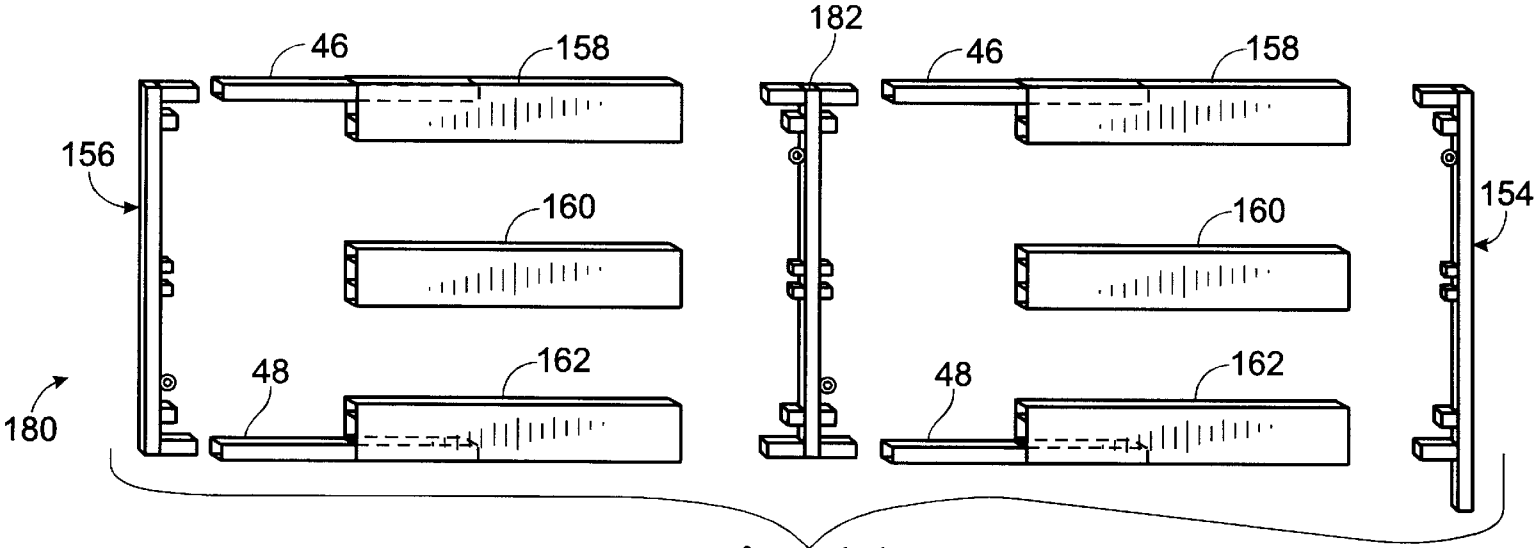
FIG. 11 is an exploded view of a double wide ranch-style vinyl gate structure of the invention.
Figure 12:
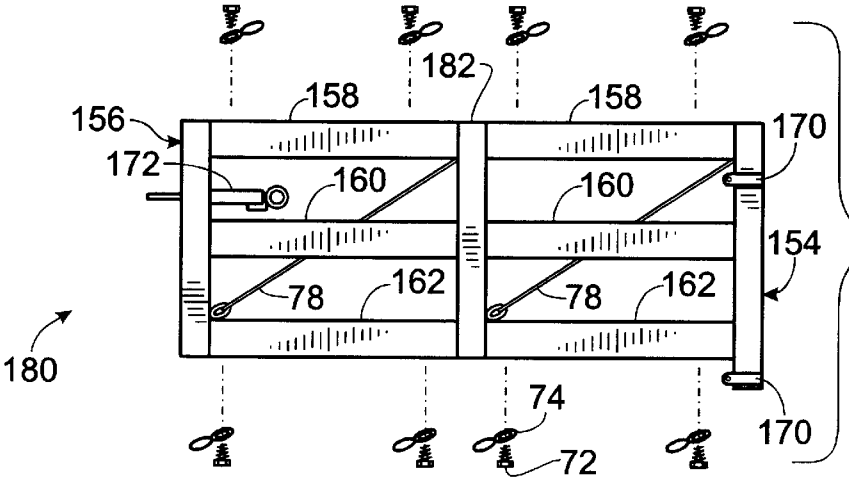
FIG. 12 is a front elevation of the assembled double wide ranch-style vinyl gate structure of FIG. 11.

Referring now to FIGS. 11 and 12, a double-wide gate is depicted generally at 180. Gate 180 includes the features of gate 150 and further includes an intermediate upright member 182 which has the cross-piece receivers, stabilizers and truss receivers installed on both sides thereof to enable the construction of a double-wide gate.

Although a number of embodiments of the gate structure have been disclosed herein, it should be appreciated that further variations and modifications may be made thereto without departing from the scope of the invention as defined in the appended claims.

I claim:

1. A vinyl gate structure, comprising:

a rectangular frame, having four corners and spaced-apart upright members, wherein each upright member includes a top cross-piece receiver and a bottom cross-piece receiver carried thereon, and which further includes a top cross-piece member received on said top cross-piece receive, and a bottom cross-piece member received on said bottom cross-piece receiver;

a top vinyl cross-piece cover and a bottom vinyl cross-piece cover covering said top and bottom cross-piece members, respectively;

vinyl web members fastened to said vinyl cross-piece covers for providing a barrier on said frame; and fasteners, located adjacent each corner of said frame, extending through said vinyl cross-piece cover, said cross-piece member, and said cross-piece receiver, for holding the gate structure together.

2. The vinyl gate structure of claim 1 wherein said upright members each include an intermediate cross-piece receiver located between said top and bottom cross-piece receivers, an intermediate cross-piece member received on said intermediate cross-piece receivers, and wherein said vinyl web members include a top vinyl web member located between said top vinyl cross-piece cover and said intermediate cross-piece member, and bottom vinyl web members located between said intermediate cross-piece member and said bottom cross-piece cover.

3. The vinyl gate structure of claim 2 wherein said top vinyl web member includes a lattice web, and wherein said bottom vinyl web members include upright slats.

4. The vinyl gate structure of claim 1 wherein said vinyl web members include upright slats.

5. The vinyl gate structure of claim 4 wherein said upright slats are closely spaced, thereby forming a solid surface.

6. The vinyl gate structure of claim 4 wherein said upright slats are spaced apart from one another.

7. The vinyl gate structure of claim 1 wherein said vinyl cross-piece covers have a vertical side and wherein said vinyl web members are fastened to said vertical sides of said vinyl cross-piece covers.

8. The vinyl gate structure of claim 1 wherein said vinyl cross-piece covers have top and bottom horizontal surfaces and wherein said top vinyl cross-piece cover has slots formed in the bottom horizontal surface thereof, said bottom vinyl cross-piece cover has slots formed in the top horizontal surface thereof, and wherein said vinyl web members are received in said slots.

9. The vinyl gate structure of claim 1 wherein said vinyl cross-piece covers include vertical surfaces thereon sand wherein said vertical surfaces of said vinyl cross-pieces covers comprise said vinyl web members.

10. The vinyl gate structure of claim 1 which further includes cross-piece stabilizers located on said upright members for stabilizing said cross-piece members.

11. A vinyl gate structure, comprising:

a rectangular metal frame, having four corners and spaced-apart upright members, wherein each upright member includes a top cross-piece receiver and a bottom cross-piece receiver carried thereon, and which further includes a top cross-piece member received on said top cross-piece receiver and a bottom cross-piece member received on said bottom cross-piece receiver, wherein said cross-piece receivers are fixed on said upright members by welding;

a top vinyl cross-piece cover and a bottom vinyl cross-piece cover covering said top and bottom cross-piece members, respectively, wherein said vinyl cross-piece covers have top and bottom horizontal surfaces and wherein said top vinyl cross-piece cover has slots formed in the bottom horizontal surface thereof, said bottom vinyl cross-piece cover has slots formed in the top horizontal surface thereof;

vinyl web members received in said slots for providing a barrier on said frame; and fasteners, located adjacent each corner of said frame, extending through said vinyl cross-piece cover, said cross-piece member, and said cross-piece receiver, for holding the gate structure together.

12. The vinyl gate structure of claim 11 wherein said upright members each include an intermediate cross-piece receiver located between said top and bottom cross-piece receivers, an intermediate cross-piece member received on said intermediate cross-piece receivers, and wherein said vinyl web members include a top vinyl web member located between said top vinyl cross-piece cover and said intermediate cross-piece member, and bottom vinyl web members located between said intermediate cross-piece member and said bottom cross-piece cover.

13. The vinyl gate structure of claim 12 wherein said top vinyl web member includes a lattice web, and wherein said bottom vinyl web members include upright slats.

14. The vinyl gate structure of claim 11 wherein said vinyl web members include upright slats.

15. The vinyl gate structure of claim 14 wherein said upright slats are closely spaced, thereby forming a solid surface.

16. The vinyl gate structure of claim 14 wherein said upright slats are spaced apart from one another.

17. The vinyl gate structure of claim 11 wherein said vertical surfaces of said vinyl cross-piece covers comprise said vinyl web members.

18. The vinyl gate structure of claim 11 which further includes cross-piece stabilizers located on said upright members for stabilizing said cross-piece members.

* * * * *